US008246378B1

(12) United States Patent
Wu et al.

(10) Patent No.: US 8,246,378 B1
(45) Date of Patent: Aug. 21, 2012

(54) TAP CONNECTOR HAVING PIVOTALLY CONNECTED FIRST AND SECOND CLAMPING PLATES WITH BLADES TO PIERCE FIRST AND SECOND WIRES

(75) Inventors: Kang Wu, Shenzhen (CN); Zheng-Heng Sun, Tu-Cheng (TW)

(73) Assignees: Hong Fu Jin Precision Industry (ShenZhen) Co., Ltd., Shenzhen, Guangdong Province (CH); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/050,955

(22) Filed: Mar. 18, 2011

(51) Int. Cl.
*H01R 13/58* (2006.01)

(52) U.S. Cl. ..... 439/467

(58) Field of Classification Search ..... 439/395–406, 439/803–806, 467, 764
See application file for complete search history.

(56) References Cited

U.S. PATENT DOCUMENTS

| | | | | |
|---|---|---|---|---|
| 3,576,518 | A * | 4/1971 | Bazille et al. | 439/402 |
| 5,746,610 | A * | 5/1998 | Shiu | 439/98 |
| 6,017,241 | A * | 1/2000 | Komai | 439/419 |
| 6,280,235 | B1 * | 8/2001 | Radliff | 439/467 |
| 6,325,671 | B1 * | 12/2001 | Radliff | 439/607.52 |
| 2005/0227529 | A1 * | 10/2005 | Mrakovich et al. | 439/402 |
| 2006/0172586 | A1 * | 8/2006 | Rosenblatt | 439/425 |

* cited by examiner

*Primary Examiner* — Chandrika Prasad
(74) *Attorney, Agent, or Firm* — Altis Law Group, Inc.

(57) ABSTRACT

A tap connector includes a first clamping plate and a second clamping plate pivotably connected to the first clamping plate. The first clamping plate and the second clamping plate each define a channel. A conductive blade extends from a sidewall of one channel. The channels of the first clamping plate and the second clamping plate corporately form a receiving space to accommodate a wire, after the second clamping plate is pivoted to the first clamping plate. The conductive blade pierces the wire to be electrically connected to the wire.

5 Claims, 4 Drawing Sheets

TAP CONNECTOR HAVING PIVOTALLY CONNECTED FIRST AND SECOND CLAMPING PLATES WITH BLADES TO PIERCE FIRST AND SECOND WIRES

BACKGROUND

1. Technical Field

The present disclosure relates to a tap connector.

2. Description of Related Art

Many data cables include a plurality of wires and two connectors electronically connected to opposite ends of the wires. In use, the two connectors of a data cable connect two electronic devices together. However, if a third electronic device also needs to share data or power with one or both of the first two devices, the data cable must be changed, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
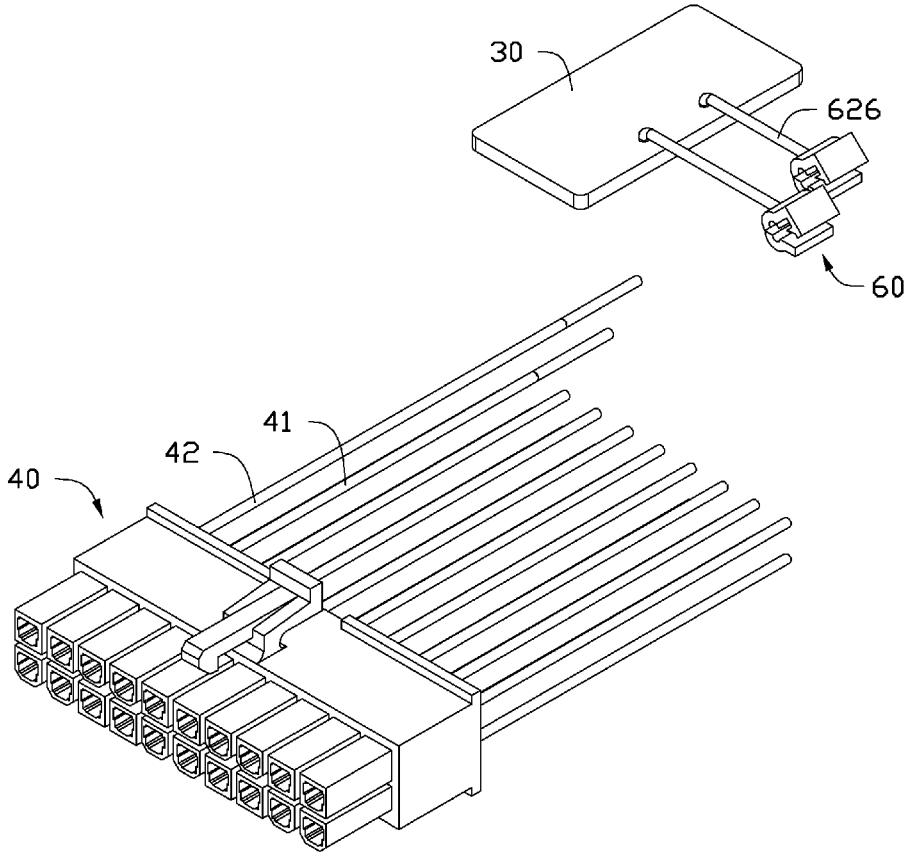
FIG. 1 is an exploded, isometric view of an exemplary embodiment of a tap connector and an electronic device, the tap connector includes connection portions.
Figure 2:
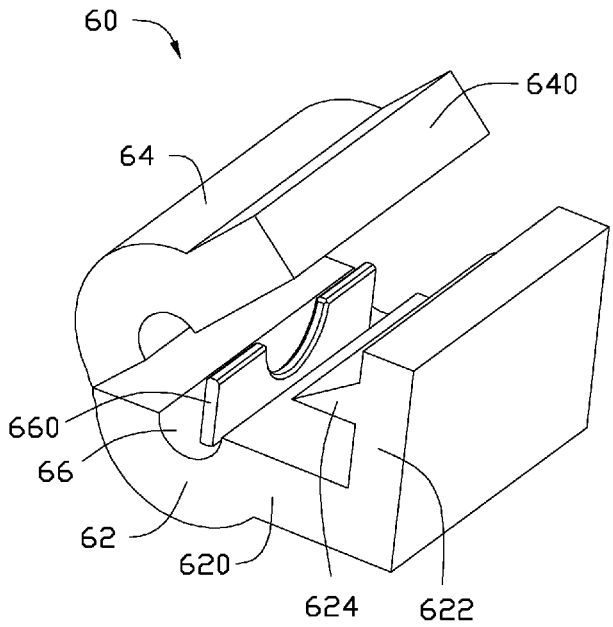
FIG. 2 is an enlarged, inverted view of one the connection portions of FIG. 1.

Referring to FIGS. 1 and 2, an exemplary embodiment of a tap connector is provided to be connected between two wires 41 and 42 of an electronic element 40 to obtain signals from the wires 41 and 42. The tap connector includes a main body 30, and two connection portions 60 electrically connected to the main body 30 by two wires 626, respectively. The main body 30 includes a connector (not shown), used to be connected to an electronic device (not shown) which makes use of the signals from the wires 41 and 42. In this embodiment, the electronic element 40 is a power connector.

Each connection portion 60 includes a first clamping plate 62, and a second clamping plate 64 pivotably connected to a first side of the first clamping plate 62. The first clamping plate 62 and the second clamping plate 64 are substantially semi-column-shaped. Centers of the first clamping plate 62 and the second clamping plate 64 each axially define a channel 66. A connection plate 620 extends from a second side of the first clamping plate 62 opposite to the first side. A positioning plate 622 substantially perpendicularly extends from one side of the connection plate 620 opposite to the first clamping plate 62. A substantially wedge-shaped elastic positioning block 624 substantially perpendicularly extends from the positioning plate 622 toward the first clamping plate 62. A conductive blade 660 extends up from a sidewall of the channel 66 of the first clamping plate 62, electrically connects to the corresponding wire 626 and is perpendicular to the connection plate 620. An engaging plate 640 extends from one side of the second clamping plate 64 opposite to the first side of the first clamping plate 62.

Figure 3:
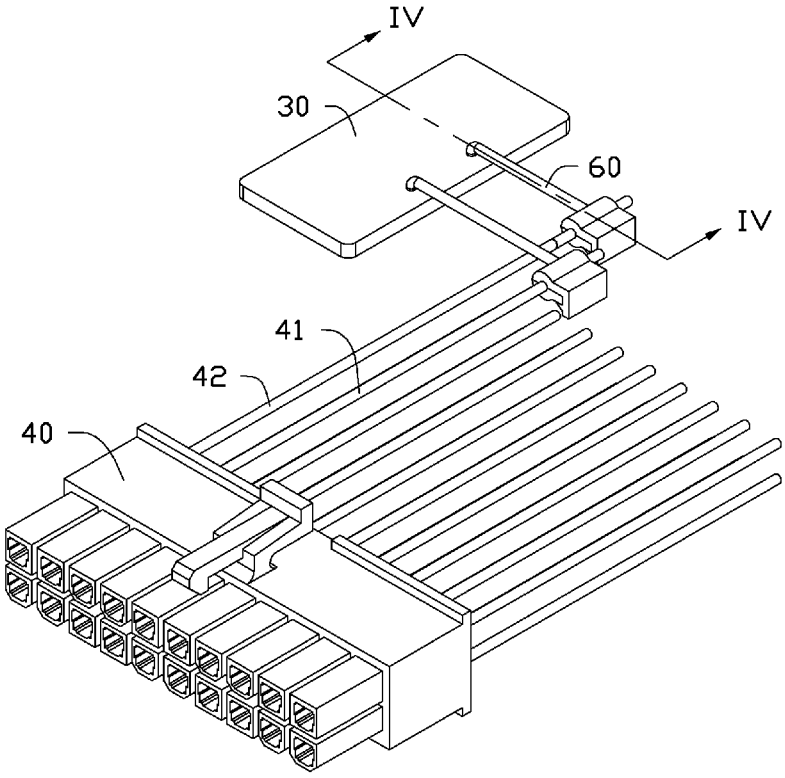
FIG. 3 is an assembled, isometric view of FIG. 1.
Figure 4:
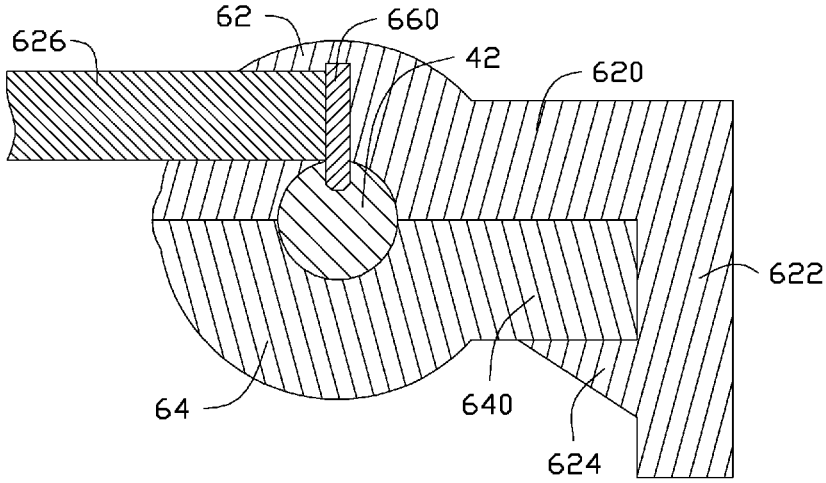
FIG. 4 is a cross-sectional view of FIG. 3, taken along the line IV-IV of FIG. 3.

Referring to FIGS. 3 and 4, in use, the wires 41 and 42 of the electronic element 40 each are axially received in the channel 66 of the first clamping plate 62 of a corresponding one of the connection portions 60. With each connection portion, the second clamping plate 64 is pivoted to the corresponding first clamping plate 62. The engaging plate 640 presses the positioning block 624 to deform the positioning block 624 toward the connection plate 620. After the engaging plate 640 moves over the positioning block 624 to contact the connection plate 620, the positioning block 624 is restored to resist against the engaging plate 640 opposite to the connection plate 620. Thereby, the engaging plate 640 is latched between the positioning block 624 and the connection plate 620, and the second clamping plate 64 is tightly fastened to the first clamping plate 62. The channels 66 of the first clamping plate 64 and the second clamping plate 62 cooperatively form a receiving space to accommodate the wire 41 or 42. The conductive blades 66 of the two connection portions 60 pierce the corresponding wires 41 and 42, to be electrically connected to the wires 41 and 42, thereby obtaining signals from the wires 41 and 42.

It is to be understood, however, that even though numerous characteristics and advantages of the embodiments have been set forth in the foregoing description, together with details of the structure and function of the embodiments, the present disclosure is illustrative only, and changes may be made in details, especially in matters of shape, size, and arrangement of parts within the principles of the embodiments to the full extent indicated by the broad general meaning of the terms in which the appended claims are expressed.

The invention claimed is:

1. An assembly comprising:

an electronic element comprising a first wire and a second wire;

a tap connector comprising a connector to be connected to an electronic device, and two connection portions electrically connected to the connector by two conductive wires, respectively;

wherein each of the connection portions comprises a first clamping plate defining a first channel, a second clamping plate pivotably connected to a first side of the first clamping plate and defining a second channel, and a conductive blade extending from a sidewall of the first channel of the first clamping plate and electrically connected to a corresponding conductive wire; wherein the first and second channels of the first clamping plate and the second clamping plate together form a receiving space to accommodate one of the first wire and the second wire; and wherein the conductive blades of the connection portions are to respectively pierce the first wire and the second wire accommodated in the corresponding receiving spaces to electrically connect the first wire and the second wire to the corresponding conductive wires, such that the electronic device makes use of the signals from the first and second wires.

2. The assembly of claim 1, wherein a connection plate extends from a second side of the first clamping plate opposite to the first side, a positioning plate substantially perpendicularly extends from one side of the connection plate opposite to the first clamping plate, an elastic positioning block substantially perpendicularly extends from the positioning plate toward the first clamping plate, and an engaging plate extends from one side of the second clamping plate opposite to the first clamping plate to be sandwiched between the connection plate and the positioning block after the second clamping plate is pivoted to the first clamping plate.

3. The assembly of claim 2, wherein the positioning block is substantially wedge-shaped.

4. The assembly of claim 2, wherein the conductive blade is substantially perpendicular to the connection plate.

5. The assembly of claim 1, wherein the first clamping plate and the second clamping plate are substantially semi-column-shaped, and the first and second channels are axially defined in centers of the first clamping plate and the second clamping plate, respectively.

* * * * *